US007107752B2

(12) United States Patent
Ognibene

(10) Patent No.: US 7,107,752 B2
(45) Date of Patent: Sep. 19, 2006

(54) SYSTEM AND A METHOD FOR MOVING AND DIVERTING TRAINS OF ARTICLES IN A CONVEYING PLANT FOR SUCH ARTICLES

(75) Inventor: Franco Ognibene, Modena (IT)

(73) Assignee: U.T.I.T. SpA., Modena (IT)

( * ) Notice: Subject to any disclaimer, the term of this patent is extended or adjusted under 35 U.S.C. 154(b) by 30 days.

(21) Appl. No.: 10/502,607

(22) PCT Filed: Jan. 30, 2003

(86) PCT No.: PCT/IB03/00274

§ 371 (c)(1),
(2), (4) Date: Jul. 26, 2004

(87) PCT Pub. No.: WO03/064739

PCT Pub. Date: Aug. 7, 2003

(65) Prior Publication Data

US 2005/0105998 A1 May 19, 2005

(30) Foreign Application Priority Data

Jan. 31, 2002 (IT) ..... BO2002A0054

(51) Int. Cl.
*D01H 9/04* (2006.01)

(52) U.S. Cl. ..... 57/268; 57/274

(58) Field of Classification Search ..... 57/268, 57/271, 274; 242/473.4, 473.5, 473.6
See application file for complete search history.

(56) References Cited

U.S. PATENT DOCUMENTS 3,946,547 A 3/1976 Salmoiraghi
4,583,358 A * 4/1986 Krieger et al. ..... 57/281
4,817,373 A * 4/1989 Gualchierani ..... 57/281
4,821,504 A * 4/1989 Shinkai et al. ..... 57/276
4,888,946 A * 12/1989 Marzioli ..... 57/267
4,979,360 A * 12/1990 Kallmann et al. ..... 57/281
5,292,081 A * 3/1994 Langen et al. ..... 242/473.6
5,715,669 A * 2/1998 Hasegawa et al. ..... 57/281
6,250,059 B1 * 6/2001 Teich ..... 57/281
6,769,854 B1 * 8/2004 Wolf et al. ..... 414/331.06

FOREIGN PATENT DOCUMENTS

DE 39 22 084 A 1/1991
EP 0 467 859 A 1/1992
IT 1 213 982 B 1/1990

* cited by examiner

*Primary Examiner*—Shaun R Hurley
(74) *Attorney, Agent, or Firm*—William J. Sapone; Coleman Sudol Sapone P.C.

(57) ABSTRACT

A system for moving and diverting trains (5) of bobbins (7) in a spinning plant with more spinning mills (1) includes a pair of rails (40,41), along which a carriage (32) moves. The carriage (32) can be stopped at a point corresponding to one spinning mill (1) and carries, mounted thereon, a motor (39), which drives the trains (5), coming from a main feeding line (3) to terminal sections (10), situated beside the spinning mills (1). Activator means (29), situated also on the carriage (32), operate the switches (20,21,22) aimed at deviating the path of the trains from the main line (3) to union sections (15) joined to the terminal sections (10). The carriage (32) is moved by a motor (42) and its position along the rails (40,41) is determined by an encoder (43).

26 Claims, 5 Drawing Sheets

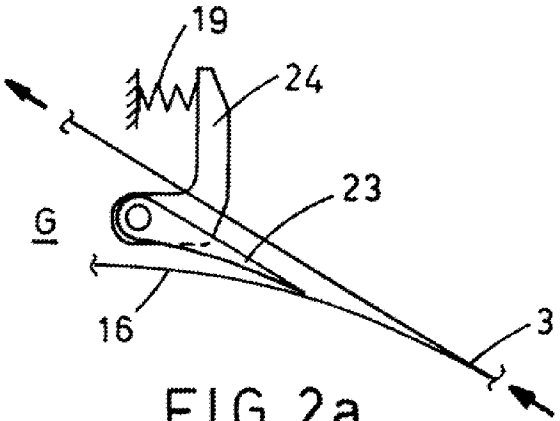
FIG. 2a
PRIOR ART
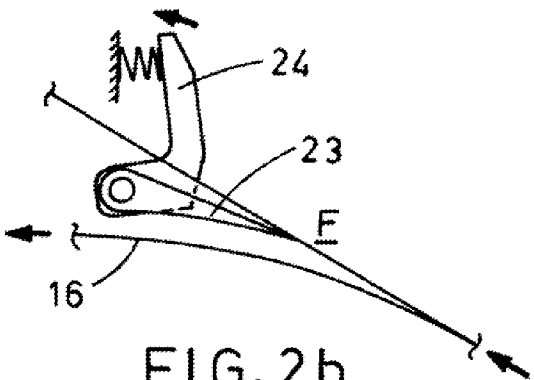
FIG. 2b
PRIOR ART
PRIOR ART
FIG. 3
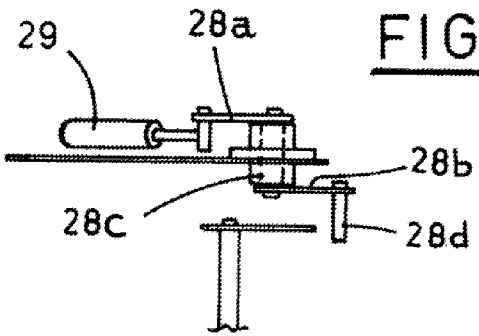
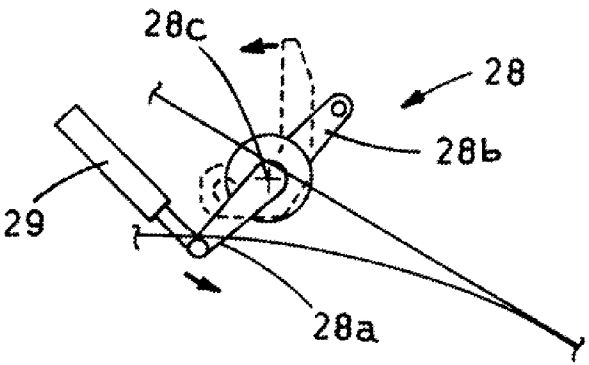
FIG. 2c
PRIOR ART FIG.5b
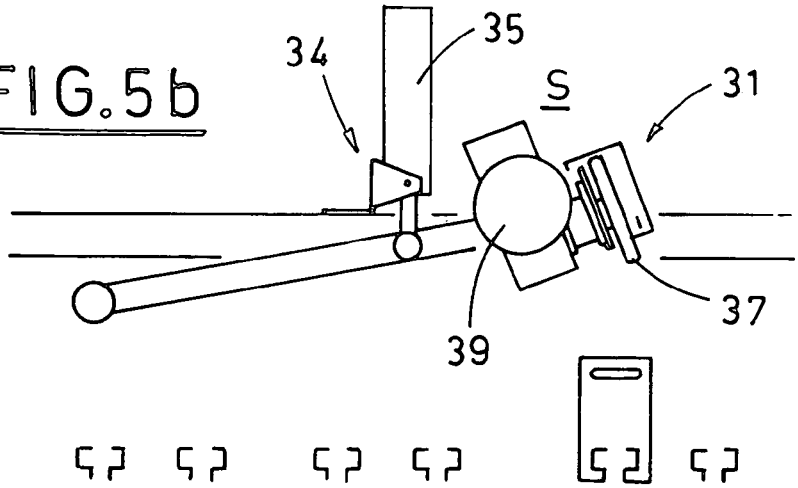
FIG.5a
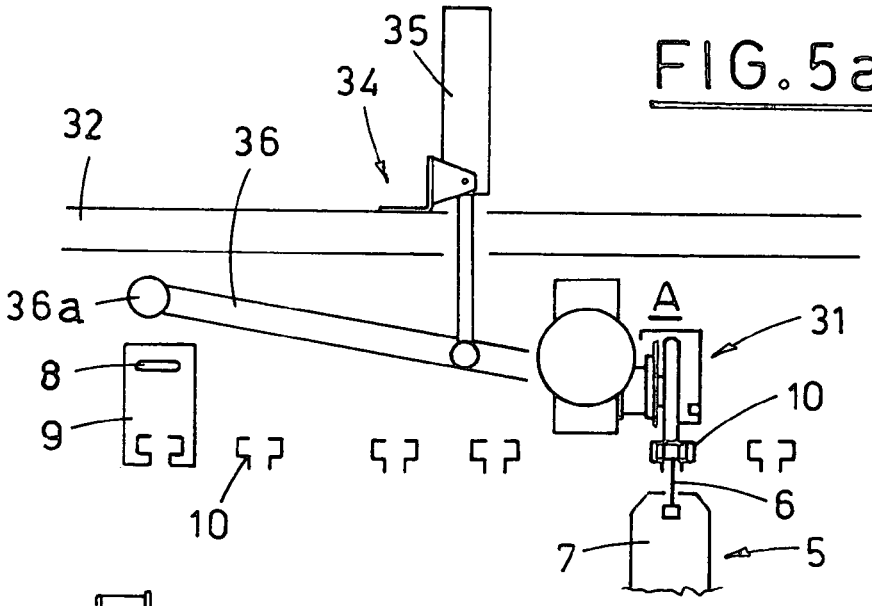
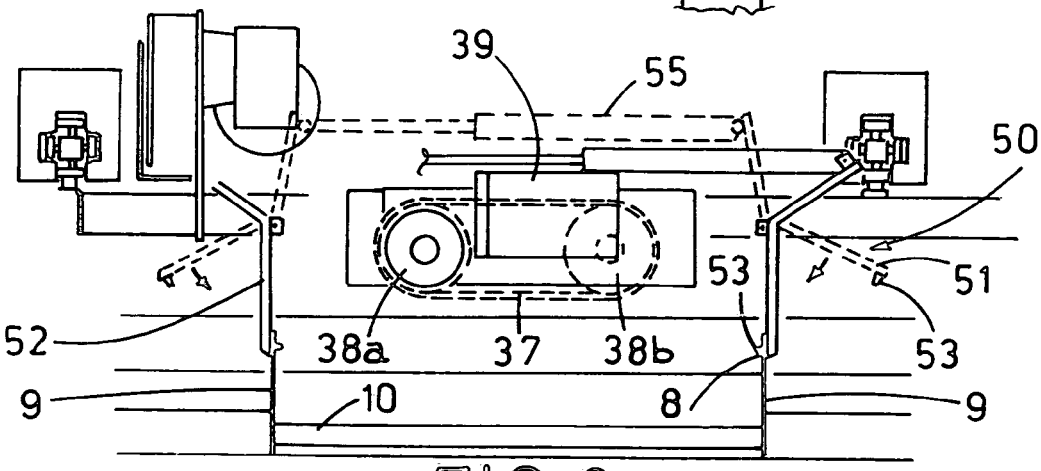
FIG.6

SYSTEM AND A METHOD FOR MOVING AND DIVERTING TRAINS OF ARTICLES IN A CONVEYING PLANT FOR SUCH ARTICLES

FIELD OF THE INVENTION

The present invention relates to a system and a method for moving and diverting trains of articles in an articles conveying plant, e.g. installed in a spinning plant in the textile industry.

In particular, the present invention concerns a system for operating switches at the deviations of the main overhead line for conveying the bobbin trains to the single overhead sections, situated beside each spinning mill, or to the sections which form a magazine, as well as for pulling the bobbin trains along the sections situated beside the spinning mills or the sections of a magazine.

In the following, reference will be made expressly to a spinning plant, although the invention can be applied to all the facilities, where it is necessary to convey and divert hooking means trains, which carry, e.g. hung thereto, articles, conveying them from one area to other determined working or dwelling stations.

BACKGROUND OF THE INVENTION

As it is known, spinning mills or other similar machines of the spinning plants are fed with bobbin rows or trains, with a roving wound around the bobbins to feed the spinning mills. The bobbin trains are moved along a monorail, which extends in the plant following suitable paths.

In some cases, the bobbin trains are temporarily placed inside magazines formed by sections of the monorail, arranged in rows placed one above another.

When the bobbins of a row, or of a train, are exhausted, or, according to different substitution techniques, are getting exhausted, the whole row is removed from the section beside the spinning mill and carried toward the bobbins filling station, while a new row of previously filled bobbins, possibly taken from the magazine, is introduced into the empty section.

The number of the rows of bobbins, which are to be brought to each side of the spinning mill, depends substantially on the type of yarn to be obtained and on the method used for feeding the spinning mill, so as to reduce as much as possible, or to eliminate, the downtimes, during which the exhausted, or getting exhausted bobbins are substituted with the full supply bobbins.

For example, the Patent Application No. BO2001A 000750, filed by the Applicant, proposes a feeding system, in which the number of bobbin rows to be supplied is twice the number of rows necessary to obtain the desired yarn. This is due to the fact that each work bobbin row has its spare bobbin row.

Therefore, the number of bobbin rows on each side of the spinning mill can reach and be even higher than eight units.

The bobbin trains travel hung, by hooking means of known type, to the links of a chain, which slides inside the monorail. The monorail is formed by a box-like body with a cross-like section.

The box-like body is open above and below, so as to allow the driving means, placed at predetermined distances, to get in touch with a flat surface of the chain dragging the bobbin train.

This type of moving, the used chain and the motor means for this operation, are described in the Italian Patent No. 1.213.982.

Besides the pulling devices arranged along the path, which extends along the whole plant, there must be also another pulling device situated for each terminal section present beside the spinning mill, to move the bobbin train, when it is introduced into and removed from the section.

Taking into consideration the fact that one spinning plant includes some tens of spinning mills and that each spinning mill can feature, situated at each side thereof, even eight or more monorail sections which form the final, bobbin dwelling section, it is easy to calculate that some hundreds of pulling devices are necessary only for the terminal dwelling sections.

The same thing relates also to the dwelling sections which form the magazine, where the bobbin trains are temporarily placed before being sent toward the spinning mills or similar machines. Further waste of means is caused by the switch devices necessary for diverting the bobbin trains from the main conveying line toward the desired terminal section of the spinning mills or of the magazine.

In order to understand the problem better, reference is made to FIG. 1*a*, which shows schematically a plant in its main parts.

The figure shows as an example only a part of the plant related to a spinning mill, and it is to be borne in mind that in case of a magazine, the plant configuration is substantially identical.

The numeral reference 3 indicates the main conveying line, along which the bobbin trains are conveyed from the spinning mills 1 to the bobbin roving frames, where the empty bobbins are substituted with the full bobbins, and then vice-versa from the magazine to the spinning mills, in order to substitute the bobbin trains getting exhausted.

Along the main path of the monorail 3, there are nodes 11, where the sections of the monorail curved toward the heads 2 of the spinning mills, branch off.

Switching devices 20 are situated in the conjunction areas 11.

Each switching device, having the configuration as shown in FIGS. 2*a*, 2*b*, 2*c*, includes a deviating plate 23, called "penna", kept elastically in such a position as not to interfere with the path of the train along the main section 3.

When the path of the arriving train is to be changed toward a selected terminal section 10 or toward a dwelling section of a magazine, an activating device 25, formed usually by an electromagnetic or pneumatic activator. The activating device moves a lever, called also cam due to its cam profile aimed at avoiding possible jamming, and determines the rotation of the deviating plate, which interferes with the path of the bobbin train, thus directing it toward the branch arm 16.

As shown in FIG. 1*a*, each side of the spinning mill is supposed to have three work bobbin rows and three spare bobbin rows. Thus, the total number of the terminal sections 10 will be twelve units.

Therefore, at the present state, twelve pulling devices 31 are needed.

The figure shows in the most complete way only the first of the terminal sections 10, however it is understood that the other terminal sections have the same configuration. The main path 3 extends gradually toward the terminal sections 10.

First, three branch arms 16 extend from the main path 3 and then each branch arm 16 is divided, thus obtaining six segments 16, 17 which are further divided obtaining twelve conjunction sections 16, 17, 18, which join with the twelve terminal sections 10.

Otherwise, the twelve conjunction segments 16, which join the main line 3 with the twelve terminal sections 10 can be used, as shown in FIG. 1*b*.

In any case, only the spinning mill shown in FIGS. 1*a* and 1*b* needs a good twelve devices activating the deviating plate 23 of twelve switches, which multiplied by the number of spinning mills determine the use of some hundreds of activators, each equipped with a relative feeding and control circuit.

The same conditions are valid for the magazine.

The high number of the devices pulling bobbin trains and devices operating the switches determines a cost increase which, if already high in small or medium plants, assumes remarkable levels for the valuation of the manufacturing costs in a big plant with hundreds of spinning mills.

SUMMARY OF THE INVENTION

The object of the present invention is to propose a system for moving and diverting bobbin trains, which can function with an extremely reduced number of devices pulling bobbin trains.

Another object of the present invention is to reduce also the number of devices operating the switches, using the same inventive concept which allows to obtain the previously described object.

A further object of the present invention is to rationalize the operation of the bobbin trains diverting system, so as to simplify its control, and consequently the relative feeding and control circuits, as well as all the problems connected with the control and diverting of the bobbin trains.

A still further object of the present invention is to carry out what above by a simple, reliable and extremely cheap solution, so as to reduce the manufacturing and maintenance costs in a determining way.

The above mentioned objects are obtained in accordance with the characteristic features contained in the main claim, by system for moving and diverting trains of articles in a plant for conveying said articles to devices for processing or storing the articles, said plant including:

one or more devices for processing or storing the articles, having each one an inlet head for the articles, by which the trains of articles are introduced, said trains of articles being formed by a plurality of articles conveyed by sliding support means;

at least one main conveying line, which extends near the inlet heads of all the devices, and which is aimed at feeding said devices with trains of articles, or at removing said trains from said devices;

a series of terminal conveying or dwelling sections, arranged in regions corresponding to said devices;

a series of union sections to connect each terminal conveying or dwelling section with the main conveying line at to respective conjunction areas;

switch means situated in each of the union sections to deviate the trains of articles from the main conveying line to the union section and to the terminal sections;

main driving means for moving the trains of articles along said main conveying line, situated at predetermined distances along the main conveying line;

terminal driving means for moving the trains of articles along said terminal conveying or dwelling sections;

power means for operating the switch means to convey the trains of articles from the main conveying line to the terminal section selected each time, by means of a corresponding union section; the system is characterized in that:

sliding and guiding means extend close to said devices, at their inlet heads;

at least one carriage slides along said sliding and guiding means, moving with respect to the devices, the carriage being stopped at a selected terminal section;

terminal driving means for driving the trains of articles along the terminal sections are mounted only on said carriage.

According to the invention, also a method is disclosed for moving and diverting trains of articles in a plant for conveying said articles to devices for processing or storing the articles, said plant including:

one or more devices for processing or storing the articles, having each one an inlet head for the articles, by which the trains of articles are introduced, the trains of articles being formed by a plurality of articles conveyed by sliding support means;

at least one main conveying line, which extends near the inlet heads of all the devices, and which is aimed at feeding said devices with trains of articles, or at removing said trains from said devices;

a series of terminal conveying or dwelling sections, arranged in regions corresponding to said devices;

a series of union sections to connect each terminal conveying or dwelling section with the main conveying line at respective conjunction areas;

switch means situated in each of the union sections to deviate the trains of articles from the main conveying line to the union sections and to the terminal sections;

main driving means for moving the trains of articles along said main conveying line, situated at predetermined distances along the main conveying line;

terminal driving means for moving the trains of articles along said terminal conveying or dwelling sections;

power means of the exchanging means to convey the trains of articles from the main conveying line to a selected terminal section, by means of a corresponding union section;

the said method is characterized in that:

sliding and guiding means extend close to said devices, at their inlet heads;

at least one carriage is made slide along said sliding and guiding means, displaced to points corresponding to the inlet heads of said devices, and stopped at a selected terminal section, so as to arrange the terminal driving means of the articles trains, mounted only on said carriage along the selected terminal sections.

BRIEF DESCRIPTION OF THE DRAWINGS

In the following, the present invention will be described in a more detailed way with reference to particular, non-limiting embodiments and with reference to the enclosed drawings, in which:

FIGS. 2*a*, 2*b*, 2*c* are schematic views of the switch means connected to the conveying line;

FIG. 3 is a lateral section view of a particular of FIG. 2*c;*

FIGS. 5*a* and 5*b* are views of a detail of the invention in two characteristic positions;

FIG. 6 shows another detail of the invention.

BEST MODES OF CARRYING OUT THE INVENTION

Figure 1A:
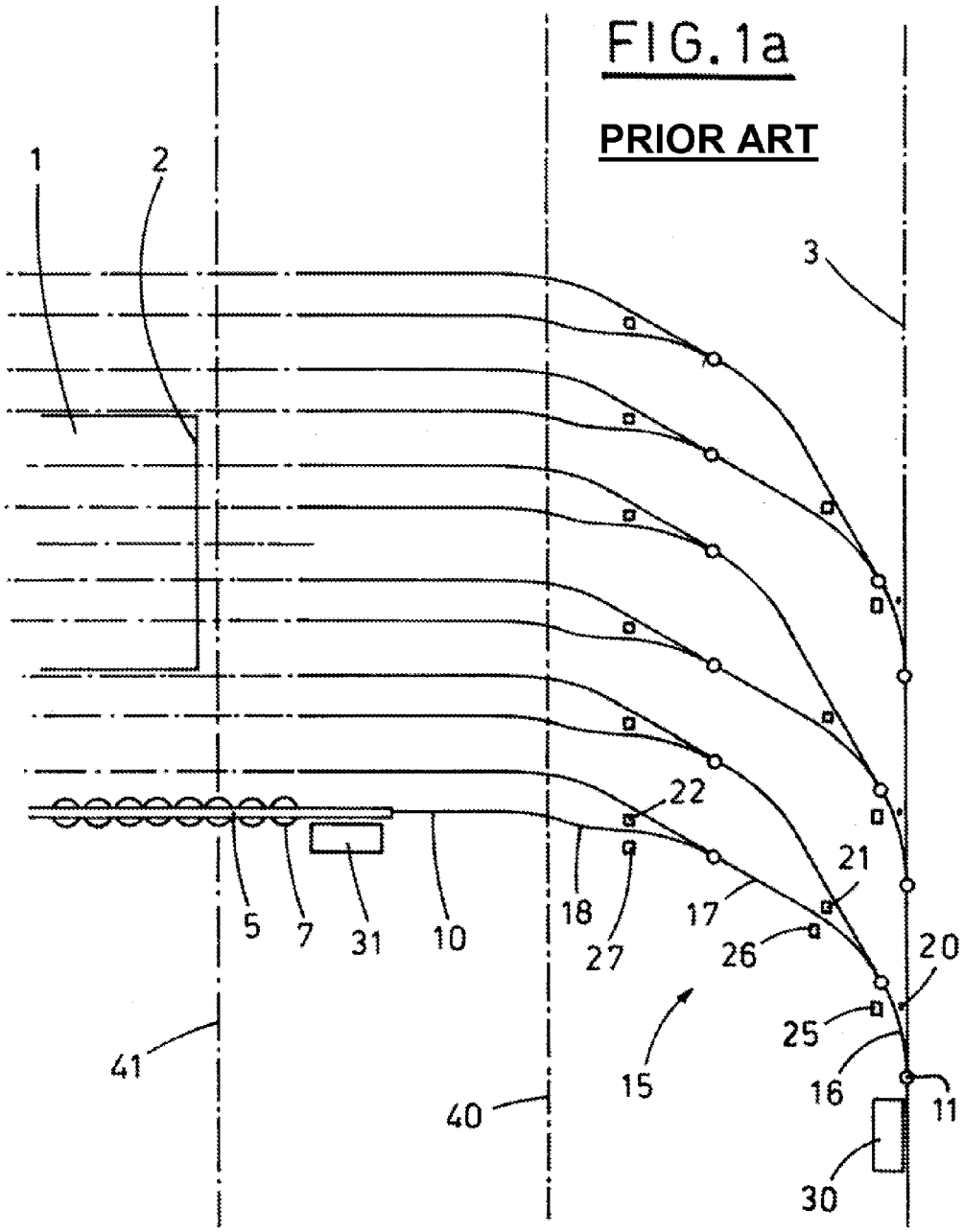
FIG. 1a PRIOR ART
FIG. 1*a* is a schematic view of the main parts of a spinning plant, in particular referred to only one spinning mill.
Figure 1B:
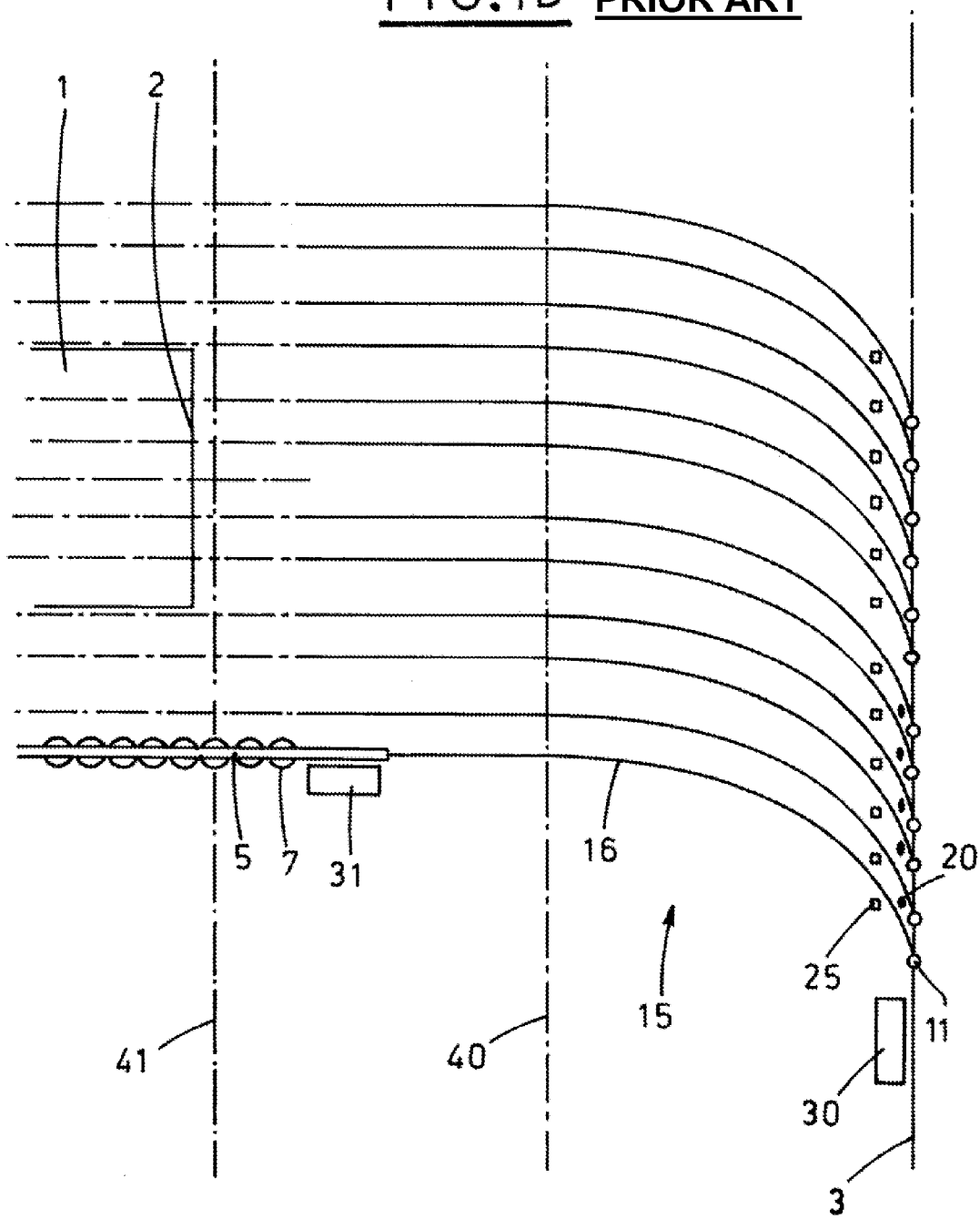
FIG.1b PRIOR ART
FIG. 1*b* is a schematic view of the main parts of the same spinning plant in a simplified form.
Figure 4:
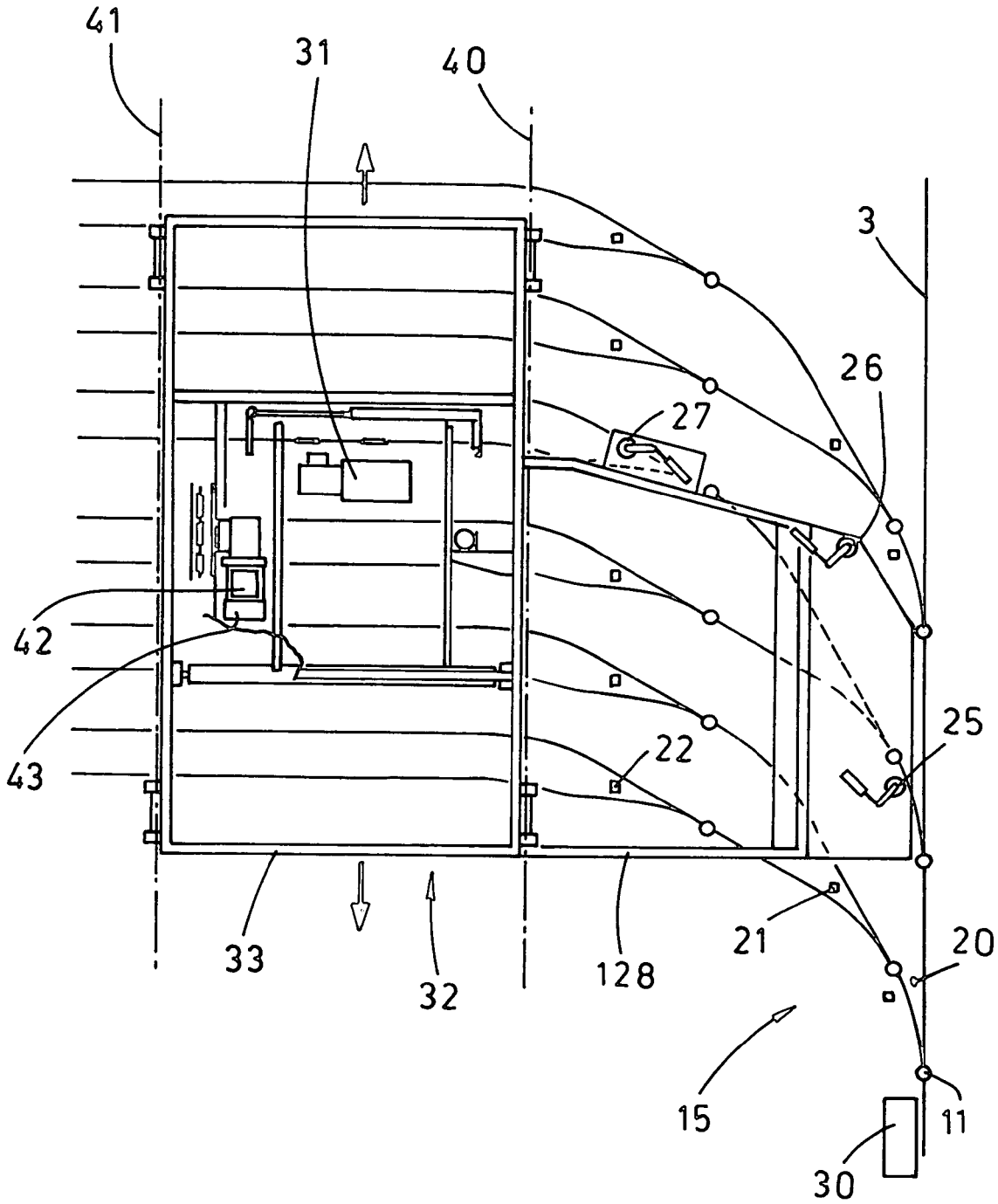
FIG. 4 is a view of the system of FIG. 1 according to the present invention.

With reference to the above described figures, now the system for moving bobbin trains 5 in a plant for spinning or other similar activity, is described.

It is to be noted that, although in the following description explicit reference will be made especially to a spinning plant, the invention can be applied to all those plants equipped with systems for conveying and diverting hooking means trains, which move articles from one area to other working or dwelling sections.

Turning to the example shown in the Figures and according to a traditional configuration, the plant includes a plurality of spinning mills 1, or similar devices, arranged parallel one to another.

For the simplicity's sake, in the following, reference will be always made only to the spinning mills, but it is understood that all the considerations and the explained technical details are likewise applied to the machines and devices which are similar to the spinning mills or, which anyway carry out the activity similar to the spinning.

Obviously, the arrangement of the spinning mills is not a constraint for the application of the present invention, after having made all the necessary modifications.

For instance, the spinning mills can be parallel and inclined.

Only one head of each spinning mill 1 is taken into consideration and defined as bobbins inlet 2. The bobbins inlet 2 is constituted by this head, where the bobbin trains 5 are introduced and subsequently removed, beside and parallel to the spinning mill 1, in order to feed the roving to the machine working sections.

The operation way, with which the roving is supplied to the spinning mills and according to which the bobbin trains 5 are substituted, is not taken into consideration here and therefore, it is not described, since it does not influence the invention applicability.

The above way can be anyone chosen from all those known and commonly adopted in the plants of this type, as it is known to those skilled in the art.

However, for the clearness' sake, it is specified that the bobbin trains 5 are formed each by a plurality of bobbins 7, hung to a link 6 of a chain, which is equipped with bearings allowing the chain to slide along a main transport line 3.

The conveying line includes e.g. a monorail, aimed at allowing the chain to slide thereinside, according to what has been shown in the Patent 1.213.982, already mentioned in the introductory statement.

The monorail includes two press-formed pieces, which are kept in reciprocal position by support plates (not shown).

The two press-formed pieces delimit a cross section, whose lower part is open, so as to allow the passage of bobbin carrying stems, hung to the links 6 of the chain supporting the bobbins 7.

The upper part of the cross section is open at least along some parts, so as to allow the means 30 pulling the bobbin trains to accede to the latter.

The means 30 pulling the bobbin trains, likewise described in the Patent 1.213.982, will be explained later on.

The main conveying line 3 extends near the inlet heads 2 of all the spinning mills.

The main driving means 30 are placed along the same main conveying line, according to appropriate distances, which are usually shorter than the bobbin trains length.

A plurality of union sections 15 branch out from the main conveying line 3 in the respective conjunction areas 11, to connect the main conveying line 3 with a series of terminal conveying sections 10 arranged on each side of each of the spinning mills 1.

Also in this case, reference will be made in the following only to the terminal sections situated beside the spinning mills, however it is understood that all the considerations and the described technical details are likewise applied to the dwelling sections of a magazine. The union sections 15 are formed by curved parts of the already mentioned monorail, while the terminal sections 10 are formed by straight sections of the same monorail.

Suitably, each union section 15 can include one or more branch arms 16, 17, 18, which are connected with as many terminal sections 10.

Switch means 20, 21, 22 are situated along each union section 15 in order to redirect the bobbin trains 5 from the main conveying line 3 toward the union sections 15 and toward the terminal sections 10.

The switch means 20, 21, 22 include each one, a deviating plate 23, hinged and oscillating on a vertical axis. In detail, the deviating plate can oscillate between a rest position G and a work position F. When in the rest position G, the deviating plate is normally kept elastically, e.g. by a spring 19, so as not to interfere with the path of the bobbin trains 5 along the monorail.

When in the work position F, the deviating plate 23 is moved by operating means 25, 26, 27, described later on, in order to deviate the bobbin train 5 toward a confluent monorail, which forms e.g. a terminal section 10 or a subsequent union section 15.

The switch means 20, 21, 22 are operated by power means 25, 26, 27 to determine the convey of the bobbin trains 5 from the main conveying line 3 to the terminal section 10, selected each time by a corresponding union section 15.

The power means 25, 26, 27 are formed e.g. by a segment 28 pivoted on a vertical axis, and acting with its free end on the deviating plate 23 and with the other end being fastened to an activator 29, formed e.g. by a pneumatic cylinder or by an electromagnetic activator. Suitably, the segment 28 is formed by two small bars 28*a*, 28*b*, joined by a vertical pin 28*c*.

The free small bar 28*b* acs on the deviating plate 23 by means of a protrusion 28*d*. In order to facilitate its operation, the deviating plate 23 is fastened to an activating lever 24, called also cam due to its cam profile, by which the deviating plate can be oriented.

The bobbin trans 5 must be moved along the terminal sections 10 by terminal driving elements 31, constructively identical to the main driving means 30. The terminal driving elements operate in the area of the terminal conveying sections 10, which is the nearest to the main conveying line 3, according to known techniques.

According to the present invention, sliding and guiding means 40, 41 extend near the spinning mills 1, in a region corresponding to their inlet heads 2.

In particular, the sliding and guiding means 40, 41 include two rails, which extend e.g. crosswise to the spinning mills 1, above the inlet head 2.

Obviously, when the spinning mills are arranged inclined and parallel one to another, or according to another possible configuration, the extension of the guiding rails will not be crosswise to the spinning mills, but it will take a corresponding position each time.

A carriage slides along the rails 40, 41 and consequently, it can move crosswise to the spinning mills 1 and it can be stopped at the point corresponding to a selected terminal section 10.

According to a first embodiment of the invention, the terminal driving means 31, which drive the bobbin trains 5 along the terminal sections 10, are placed only on the carriage 32. According to a second embodiment of the invention, also the operating means 25, 26, 27 of the switch means 20, 21, 22 are placed only on the carriage 32.

In particular, the carriage 32 includes a frame 33 sliding along the rails 40, 41, on which the terminal driving elements 31 are mounted for driving the bobbin trains coming from the union section 15 along the terminal sections 10.

The terminal driving elements 31 are mounted on an oscillating support 34 and are operated by an activator element 35, e.g. a pneumatic cylinder, so as to move between a raised rest position S, and a lowered operating position A.

When in the rest position S, the terminal driving elements 31 are far from and raised with respect to the conveying terminal section 10. When in the operating position A, the terminal driving elements 31 are brought close to the selected terminal conveying section 10 and engage with a bobbin train 5 being introduced into, or removed from the same terminal section. In this condition, the terminal driving means drive the bobbin trains.

The oscillating support 34 includes a bar 36, hinged on one end 36*a* to the carriage 32 and carrying the terminal driving elements 31 in correspondence to the other free end 36*b*.

The terminal driving elements 31 include an endless belt 37 wound around two pulleys 38*a*, 38*b*, whose rotation axis is transversal with respect to the terminal conveying sections 10.

One of the pulleys is connected to a motor 39, which drives it to rotate, thus making the belt push on the upper part of the bobbin carrying link 6 and consequently move the bobbin train 5 each time in the desired direction.

The correct positioning of the carriage 32 is ensured by means for determining its position with respect to the spinning mills 1 and to the terminal sections 10 selected each time. More precisely, the carriage 32 is moved by a motor 42 mounted on the carriage and suitably equipped with a motor speed-reducer.

An output pinion of the motor engages with a rack, not shown, which extends along the rail 41.

Operation of the motor drives the carriage to move along the rails 40, 41.

According to another possible solution, a chain is arranged beside or above the rail 41 and moves along a path defined between the three pulleys, which are equipped with suitable seats and mounted on the carriage.

One of the pulleys is connected to the motor 42, which, once activated, drives the pulleys to rotate on the chain, thus moving the carriage.

A belt can be provided instead of the chain.

It is also possible to fasten the chain or the belt to the carriage and to place a motor, which drives the endless chain or the belt to rotate, in a fixed position.

In this case, there will be no motor 42 on the carriage 32.

The carriage driving system has not been illustrated in a detailed way, because it is of known type and easily within the reach of those skilled in the art.

The correct positioning of the carriage 32 with respect to the rails 40, 41 and consequently, with respect to the spinning mills 1 and to the terminal sections 10, is obtained by using an encoder 43 situated on the carriage and connected, in a known way, to the carriage driving system.

The encoder 43 measures the displacement of the carriage, thus defining the correct position thereof.

Locking means 50 fasten removably the carriage to the terminal section 10, selected each time, in order to allow an efficient dragging action on the bobbin trains 5 and in order to give a good stability to the carriage.

In particular, the locking means include two arms 51, 52, hinged to the frame of the carriage 32 and equipped with pins 53 fastened crosswise in regions corresponding to their free ends.

The arms 51, 52 are operated to oscillate by activator means 55, e.g. a pneumatic cylinder, so that the pins 53 engage with corresponding slots 8 made in the plates 9 fastened to the terminal sections 10. The activation of the locking means allows to fix the carriage to the selected terminal section 10.

The carriage 32 includes also an appendix 128 extending therefrom. The switch power means 25, 26, 27, operating the switch means, are mounted on the appendix 128 in relation to the configuration of the plant.

According to a simplified configuration, the appendix 128 extending from the carriage 32, carries only some of the means operating the switch means, e.g. only the switch operating means 26 and 27 situated in a region corresponding to the union sections nearest to the spinning mills heads.

In this case, the remaining switch means 20, situated along the main conveying line 3 are operated by respective fixed means.

It is easy to understand, from the description, the system operation and in particular, the method, proposed by the invention, for feeding bobbin trains in a spinning plant.

Actually, according to the method, the carriage 32 is displaced, by a movement crosswise with respect to the spinning mills 1, and stopped at a point corresponding to the selected terminal section 10 due to the reading of the data emitted by the encoder.

At this point, the operating means 25, 26, 27 of the switch means 20, 21, 22 and the terminal driving means 31 for moving the bobbin trains 5 along the terminal sections 10, are situated in their correct positions, in order to remove a train of empty bobbins from the selected terminal section 10 and to introduce a train of full bobbins 5.

First, the operating means 25, 26, 27 of the switch means 20, 21, 22 are activated, according to a suitable combination, to determine the conveying of the empty bobbin train 5 from the selected terminal section 10 to the conveying line 3.

Then, the bar 36 is lowered by bringing the belt 37 of the driving means 31 to a position suitable to engage and drive the bobbin train.

The operating of the locking means, i.e. the downward oscillation of the arms 51 and 52, with engagement of the pins 53 with the slots 8 of the plates 9, determines the fastening of the carriage with respect to the terminal sections 10.

Then, the motor 39 is operated to move the empty bobbin train 5 dwelling at the outlet of the terminal section 10, to exit therefrom.

After the empty bobbin train has been conveyed onto the main conveying line 3 and subsequently carried to the area, in which the empty bobbins are substituted with the full ones, the motor 39 of the driving means 31 is started in the opposite direction, so as to introduce the full bobbin train, arriving to the conveying line 3, e.g. coming from a magazine, into the just freed terminal section 10.

Consequently, the carriage is immediately unlocked, thus releasing the action of the locking means 50, and then moved toward a new terminal section 10, which must be supplied with a full bobbin train.

The carriage movement, like the general operation of the whole system, is controlled by a suitable command and control unit, which is connected, in a known consolidated way, to different command and control points, and to which the operators can accede to define working times and operation modes by traditional interface means, such as keyboards, displays, push-button panels, etc.

The control unit and the access means, as well as its connections to the system, have not been described and illustrated, since known to those skilled in the art.

As it has been said previously, the operation and constructive configuration of the system proposed by the invention is valid also for a magazine, where the bobbin trains are temporarily placed.

In this case, the carriage, or a part of it, can move also vertically, in order to work also with more planes of dwelling sections, arranged one over another.

It is also obvious how all the mentioned before objects are obtained.

Actually, the whole system has only one terminal driving element 31, independently from the number of spinning mills, and this terminal driving element is moved by the carriage 32 to the points, where its intervention is needed.

Also the power means for operating the switches are drastically reduced to a minimum number and are placed in the intervention area each time.

The times, in which the bobbin rows get exhausted are long enough to allow a cyclical operation of the system for positioning the carriage and the working means necessary to perform the exchange of the bobbin trains.

Therefore, the proposed system for moving and diverting bobbin trains operates with an extremely reduced number of elements for driving the bobbin trains and means for operating the switches along the conveying lines, thus causing a considerable reduction of construction and maintenance costs.

Moreover, the operation of the system for moving and diverting bobbin trains is rationalized and simplified, and so is its control, and consequently, the relative feeding and control circuits, as well as all the problems related to the control and diverting of the bobbin trains. It is to be pointed out that it is much easier to shape the control system of the operation of the diverting the bobbin trains, because each thing is subjected to a computerized central control unit, managed by a suitable program.

All what above allows to obtain also a simple and reliable solution, easily adaptable to different operation needs.

Although preferred embodiments have been illustrated and described, it is understood by the experts in the field that possible changes can be applied without changing the protective scope of the invention.

The invention claimed is:

1. A system for moving and diverting trains of articles in a plant for conveying said articles to devices for processing or storing the articles, said plant including:

one or more devices (1) for processing or storing the articles, having each one an inlet head for the articles (2), through which the trains (5) of articles are introduced, said trains of articles being formed by a plurality of articles (7) conveyed by sliding support means (6);

at least one main conveying line (3), which extends near the inlet heads (2) of all the devices (1), and which is aimed at feeding said devices with trains (5) of articles (7), or at removing said trains from said devices;

a series of terminal conveying or dwelling sections (10), arranged in regions corresponding to said devices (1);

a series of union sections (15) to connect each terminal conveying or dwelling section (10) with the main conveying line (3) in a region corresponding to respective conjunction areas (11);

switch means (20,21,22) situated in each of the union sections (15) to deviate the trains (5) of articles from the main conveying line (3) to the union section (15) and to the terminal sections (10);

main driving means (30) for moving the trains of articles along said main conveying line (3), situated at predetermined distances along the main conveying line;

terminal driving means (31) for moving the trains (5) of articles along said terminal conveying or dwelling sections (10);

power means (25,26,27) for operating the switch means (20,21,22) to convey the trains of articles from the main conveying line (3) to the terminal section (10) selected each time, by means of a corresponding union section (15);

said system being characterized in that:

sliding and guiding means (40,41) extend close to said devices (1), in a region corresponding to their inlet heads (2);

at least one carriage (32) slides along said sliding and guiding means (40,41), moving with respect to said devices (1), said carriage being then stopped at a selected terminal section (10);

terminal driving means (31) for driving the trains of articles along the terminal sections (10) are mounted only on said carriage (32).

2. A system, according to claim 1, characterized in that also said power means (25,26,27) for operating the switch means (20,21,22) are mounted only on said carriage (32).

3. A system, according to claim 1, characterized in that said sliding and guiding means (40,41) include one or more rails, which extend crosswise with respect to said devices (1), above the inlet head (2) thereof.

4. A system, according to claim 1, characterized in that said carriage (32) includes a frame (33), which slides along said sliding and guiding means (40,41), and which carries, mounted thereon said power means (25,26,27) for operating the switch means (20,21,22) and the terminal driving means (31) for driving the bobbin trains coming from the union sections (15) along the terminal sections (10).

5. A system, according to claim 2, characterized in that said carriage (32) includes a frame (33), which slides along said sliding and guiding means (40,41), and which carries, mounted thereon said power means (25,26,27) for operating the switch means (20,21,22) and the terminal driving means (31) for driving the bobbin trains coming from the union sections (15) along the terminal sections (10).

6. A system, according to claim 4, characterized in that said terminal driving means (31) are mounted on an oscillating support (34), operated by activator means (35) to move between a rest position (S), in which said terminal driving means (31) are far from the terminal conveying section (10), and an operating position (A), in which said terminal driving means (31) are brought to the selected terminal section (10) to engage and drive a train (5) of articles, which is introduced into said terminal section (10).

7. A system, according to claim 6, characterized in that said oscillating support (34) includes a bar (36), whose one end (36*a*) is hinged to said carriage (32) and whose other, free end (36*b*) carries said terminal driving means (31).

8. A system, according to claim 4, characterized in that said terminal driving means (31) include an endless belt (37), wound around two pulleys (38*a*,38*b*), whose rotation axis is transversal with respect to the terminal conveying section (10), with at least one of the pulleys being connected to a motor (39).

9. A system, according to claim 4, characterized in that it includes an appendix (128), which extends from said carriage (32) and which features, connected thereto, power means (25) for operating the switch means (20), situated along the main conveying line (3) in regions corresponding to said union sections (15).

10. A system, according to claim 4, characterized in that each of the union sections (15) includes one or more segments (16,17,18), which are connected with as many terminal sections (10), and power means (20,21,22) for operating said switch means are situated in more points of said carriage (32).

11. A system, according to claim 10, characterized in that it includes an appendix (128), which extends from said carriage (32) and which features, connected thereto, some or all power means (25,26,27) for operating the switch means.

12. A system, according to claim 1, characterized in that it includes locking means (50) for locking said carriage to the terminal section (10), selected each time.

13. A system, according to claim 12, characterized in that said locking means include two arms (51,52) hinged to said carriage (32) and equipped with pins (53) fastened crosswise to the free ends, said arms (51,52) being operated, by power means (55), to oscillate, so that the pins (53) engage with corresponding slots (8) made in the plates (9) fastened to the terminal sections (10), thus fastening the carriage to the selected terminal section (10).

14. A system, according to claim 1, characterized in that:

said main conveying line includes a monorail which allows said sliding support means (16) to slide;

said union sections (15) are formed by curved parts of the monorail;

said terminal sections (10) are formed by straight parts of the monorail;

said switch means (20,21,22) are formed, each by a deviating plate (23) hinged and oscillating on a vertical axis between a rest position (G), in which it is normally kept elastically, so as not to interfere with the path of the trains (5) along the monorail, and an operating position (F), in which said deviating plate (23) is moved by said power means (25,26,27) to deviate the train (5) of articles to a confluent piece of the monorail, which forms a said terminal section (10) or a subsequent piece of a union section (15);

said power means (25,26,27) are formed by a segment (28), articulated rocking on a vertical axis, and acting with its free end on said deviating plate (23) and with the other end being fastened to an activator (29).

15. A system, according to claim 14, characterized in that said segment (28) is formed by two small bars (28*a*,28*b*), joined by a vertical pin (28*c*), with the small bar (28*a*) fastened to said activator (29), and with the other, free, small bar (28*b*) acting on said deviating plate (23) by a protrusion (28*d*).

16. A system, according to claim 14, characterized in that an activating lever (24) is made integral with said deviating plate (23) with possibility to change the orientation of the latter.

17. A system, according to claim 16, characterized in that said activating lever (24) has a cam profile.

18. A system, according to claim 1, characterized in that it includes means for determining the positioning (42,43) of said carriage (32) with respect to said devices (1) and to the terminal sections (10), selected each time.

19. A system, according to claim 18, characterized in that said means for determining the positioning of said carriage include a motor (42), mounted on said carriage and acting on said sliding and guiding means (40,41) to move the carriage.

20. A system, according to claim 18, characterized in that said means for determining the positioning of said carriage include an encoder (43), operated in accordance with the motion of carriage along said sliding and guiding means.

21. A system, according to claim 18, characterized in that said means for determining the positioning of said carriage include a motor mounted in a fixed position on the carriage and acting on said carriage by driving means.

22. A system, according to claim 1, characterized in that said articles include bobbins (7) of roving for spinning and in that said devices (1) are spinning mills or other similar machines.

23. A system, according to claim 1, characterized in that said articles include bobbins (7) of roving for spinning and in that said devices (1) are magazines for bobbin trains or other similar storing devices.

24. A method for moving and diverting of trains of articles in a plant for conveying said articles to devices for processing or storing the articles, said plant including:

one or more devices (1) for processing or storing the articles, having each one an inlet head for the articles (2), through which the trains (5) of articles are introduced, said trains of articles being formed by a plurality of articles (7) conveyed by sliding support means (6);

at least one main conveying line (3), which extends near the inlet heads (2) of all the devices (1), and which is aimed at feeding said devices with trains (5) of articles (7), or at removing said trains from said devices;

a series of terminal conveying or dwelling sections (10), arranged in regions corresponding to said devices (1);

a series of union sections (15) to connect each terminal conveying or dwelling section (10) with the main conveying line (3) at respective conjunction areas (11);

switch means (20,21,22) situated in each of the union sections (15) to deviate the trains (5) of articles from the main conveying line (3) to the union sections (15) and to the terminal sections (10);

main driving means (30) for moving the trains of articles along said main conveying line (3), situated at predetermined distances along the main conveying line;

terminal driving means (31) for moving the trains (5) of articles along said terminal conveying or dwelling sections (10);

power means (25,26,27) of the exchanging means (20,21,22) to convey the trains of articles from the main conveying line (3) to a selected terminal section (10), by means of a corresponding union section (15);

said method being characterized in that:

sliding and guiding means (40,41) extend close to said devices (1), in a region corresponding to their inlet heads (2);

at least one carriage (32) is made slide along said sliding and guiding means (40,41), displaced to points corresponding to the inlet heads (2) of said devices (1), and stopped at a selected terminal section (10), so as to arrange the terminal driving means (31) of the articles trains, mounted only on said carriage (32), along the selected terminal sections (10).

25. A method, according to claim 24, characterized in that also said power means (25,26,27) for operating the switch means (20,21,22) are mounted on said carriage (32) and positioned by moving the carriage.

26. A method, according to claim 14, characterized in that said power means (25,26,27) for operating the switch means (20,21,22) and of said terminal driving means (31) for driving the trains (5) of articles along the terminal sections (10) are displaced crosswise with respect to said devices (1), and are operated when said carriage (32) is stopped at a selected terminal section (10).

* * * * *